US011155285B2

(12) United States Patent
Beier et al.

(10) Patent No.: US 11,155,285 B2
(45) Date of Patent: Oct. 26, 2021

(54) OPTICAL SYSTEM FOR A LED SIGNAL AND WAYSIDE LED SIGNAL

(71) Applicant: Siemens Industry, Inc., Alpharetta, GA (US)

(72) Inventors: Axel Beier, Schildow (DE); Volker Türck, Berlin (DE)

(73) Assignee: Siemens Mobility, Inc., New York, NY (US)

( * ) Notice: Subject to any disclaimer, the term of this patent is extended or adjusted under 35 U.S.C. 154(b) by 375 days.

(21) Appl. No.: 16/310,134

(22) PCT Filed: Jun. 28, 2016

(86) PCT No.: PCT/US2016/039778
§ 371 (c)(1),
(2) Date: Dec. 14, 2018

(87) PCT Pub. No.: WO2018/004534
PCT Pub. Date: Jan. 4, 2018

(65) Prior Publication Data

US 2019/0329803 A1 Oct. 31, 2019

(51) Int. Cl.
*B61L 5/00* (2006.01)
*B61L 5/18* (2006.01)
(Continued)

(52) U.S. Cl.
CPC ..... *B61L 5/1845* (2013.01); *B61L 9/04* (2013.01); *F21V 5/045* (2013.01); *G08G 1/095* (2013.01);
(Continued)

(58) Field of Classification Search
CPC ..... B61L 5/1845; B61L 9/04; B61L 2207/02; F21V 5/045; G08G 1/095; F21W 2111/00
See application file for complete search history.

(56) References Cited

U.S. PATENT DOCUMENTS 5,139,609 A * 8/1992 Fields ..... H01S 3/09415 216/2
5,612,821 A * 3/1997 Schmutz ..... G02B 3/0062 359/619
(Continued)

FOREIGN PATENT DOCUMENTS

EP 0935145 A1 8/1999
EP 1012023 A1 6/2000

OTHER PUBLICATIONS

PCT International Search Report and Written Opinion of International Searching Authority dated Mar. 22, 2017 corresponding to PCT International Application No. PCT/US2016/039778 filed Jun. 28, 2016.

*Primary Examiner* — Gerald J Sufleta, II

(57) ABSTRACT

An optical system (100) for a light emitting diode (LED) signal includes a plurality of light emitting diodes (LEDs) (12, 14), a plurality of optical lenses (20, 40, 60, 80) for diverging and collimating light generated by the plurality of LEDs (12, 14), wherein the plurality of LEDs (12, 14) and the plurality of optical lenses (20, 40, 60, 80) are sequentially arranged in an axial direction, and wherein the plurality of optical lenses (20, 40, 60, 80) are configured such that by altering an axial position of one of the optical lenses (20, 40, 60, 80) from a first defined axial position to a second defined axial position, a final angular light distribution of the optical system (100) is variable.

18 Claims, 11 Drawing Sheets

(51) Int. Cl.

| | |
|---|---|
| ***B61L 9/04*** | (2006.01) |
| ***F21V 5/04*** | (2006.01) |
| ***G08G 1/095*** | (2006.01) |
| *F21W 111/00* | (2006.01) |

(52) U.S. Cl.
CPC ..... *B61L 2207/02* (2013.01); *F21W 2111/00* (2013.01)

(56) References Cited

U.S. PATENT DOCUMENTS 8,733,981 B2 * 5/2014 Jiang ..... F21V 5/04 362/311.02
9,169,997 B2 * 10/2015 Kurt ..... F21V 14/06
9,360,169 B2 * 6/2016 Zhang ..... G02B 19/0061
9,599,763 B2 * 3/2017 Larat ..... G02B 6/0006
9,736,895 B1 * 8/2017 Dong ..... F21V 23/0457
9,791,132 B2 * 10/2017 Li ..... F21K 9/60
9,798,126 B2 * 10/2017 Tilleman ..... G02B 3/04
2005/0174775 A1 * 8/2005 Conner ..... G02B 27/148 362/268
2009/0296407 A1 * 12/2009 Bailey ..... F21V 7/0091 362/309
2011/0134636 A1 * 6/2011 Chang ..... F21V 5/045 362/235
2013/0265545 A1 * 10/2013 Buckland ..... A61B 3/102 351/206
2015/0159830 A1 * 6/2015 Joergensen ..... F21V 5/007 362/237
2015/0370048 A1 * 12/2015 Takano ..... G03B 21/28 359/443
2017/0276319 A1 * 9/2017 Shigematsu ..... F21S 8/083
2017/0292682 A1 * 10/2017 Sepkhanov ..... G02B 27/30
2018/0009453 A1 * 1/2018 Eckl ..... F21V 3/00
2018/0024428 A1 * 1/2018 Choi ..... G02B 13/16 353/20
2018/0195684 A1 * 7/2018 Vissenberg ..... F21V 5/045
2018/0266655 A1 * 9/2018 Beaumont ..... F21V 5/043
2018/0267362 A1 * 9/2018 Gahagan ..... G02B 3/0068
2019/0186706 A1 * 6/2019 Kim ..... F21S 41/40

* cited by examiner

OPTICAL SYSTEM FOR A LED SIGNAL AND WAYSIDE LED SIGNAL

CROSS REFERENCE TO RELATED APPLICATIONS

This Application is the U.S. National Stage of International Application No. PCT/US2016/039778 filed 28 Jun. 2016 and claims benefit thereof, the entire content of which is hereby incorporated herein by reference.

BACKGROUND

1. Field

Aspects of the present invention generally relate to an optical system for a light emitting diode (LED) signal and a wayside LED signal.

2. Description of the Related Art

The railroad industry employs wayside signals to inform train operators of various types of operational parameters. For example, coloured wayside signal lights are often used to inform a train operator as to whether and how a train may enter a block of track associated with the wayside signal light. The status/colour of wayside signal lamps is sometimes referred to in the art as the signal aspect. One simple example is a three colour system known in the industry as Automatic Block Signaling (ABS), in which a red signal indicates that the block associated with the signal is occupied, a yellow signal indicates that the block associated with the signal is not occupied but the next block is occupied, and green indicates that both the block associated with the signal and the next block are unoccupied. It should be understood, however, that there are many different kinds of signaling systems. Other uses of signal lights to provide wayside status information include lights that indicate switch position, hazard detector status (e.g., broken rail detector, avalanche detector, bridge misalignment, grade crossing warning, etc.), search light mechanism position, among others.

Wayside signal lights are coupled to and controlled by a railway interlocking, also referred to as interlocking system or IXL, which is a safety-critical distributed system used to manage train routes and related signals in a station or line section, i.e. blocks of tracks. There are different interlocking types, for example vital relay-based systems or vital processor-based systems that are available from a wide variety of manufacturers.

Existing wayside signal lights can include incandescent bulbs or light emitting diodes (LEDs). The benefits of wayside signals with LEDs are improved visibility, higher reliability and lower power consumption.

Known wayside LED signals are designed for example as a unit with a large number of LEDs, for example from 88 to 96 LEDs, which can be expensive due to the large number of LEDs and due to the fact that a large printed circuit board (PCB) is needed since LEDs are typically mounted on a PCB. Other known configurations may comprise a smaller number of LEDs, for example a LED chip designed as a central light source, but such a configuration when incorporated into a wayside signal may result in a LED signal with a large axial length which is undesirable. Thus, there exists a need for an optical system for a LED signal which includes a small number of light sources, provides sufficient light output for different viewing angles as well as a compact design.

SUMMARY

Briefly described, aspects of the present invention relate to an optical system for a light emitting diode (LED) signal and a wayside LED signal. In particular, the LED signal is configured as a railroad wayside signal for installing along railroad tracks. One of ordinary skill in the art appreciates that such a LED signal can be configured to be installed in different environments where signals and signaling devices may be used, for example in road traffic.

A first aspect of the present invention provides an optical system for a light emitting diode (LED) signal comprising a plurality of light emitting diodes (LEDs), a plurality of optical lenses for diverging and collimating light generated by the plurality of LEDs, wherein the plurality of LEDs and the plurality of optical lenses are sequentially arranged in an axial direction, and wherein the plurality of optical lenses are configured such that by altering an axial position of one of the optical lenses from a first defined axial position to a second defined axial position, a final angular light distribution of the optical system is variable.

A second aspect of the present invention provides a wayside LED signal comprising a plurality of light emitting diodes (LEDs); a plurality of optical lenses for diverging and collimating light generated by the plurality of LEDs, wherein the plurality of LEDs and the plurality of optical lenses are sequentially arranged in an axial direction, and wherein the plurality of optical lenses are configured such that by altering an axial position of one of the optical lenses from a first defined axial position to a second defined axial position, a final angular light distribution of the optical system is variable.

DETAILED DESCRIPTION

To facilitate an understanding of embodiments, principles, and features of the present invention, they are explained hereinafter with reference to implementation in illustrative embodiments. In particular, they are described in the context of being an optical system for a LED signal and a wayside LED signal. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

The optical system for a LED signal as described herein comprises multiple components, which will be described in detail with reference to the following FIGS. 1-17. The provided optical system 100 fulfils specific requirements of axial luminous intensity (related to axial visibility range), angular distribution (related to visibility at specific track radii) and near-distance-recognition as will be described later.

In summary, light generated by at least one LED is collimated to a parallel beam by a first lens, which is configured as an assembly comprising at least one converging lens. For multiple LEDs, multiple converging lenses are provided such that each LED uses one converging lens. The parallel beam(s) produced by the first lens assembly is refracted by a second lens, which is configured as a diverging lens, onto a third lens. The third lens operates as a converging lens, and can be designed for example as a Fresnel lens, that collimates the light to a defined small divergence angle. A fourth lens comprises an array of identical converging lenses, herein also referred to as lenslets, arranged for example on a plano-parallel or curved plate. The fourth lens is designed to refract the light beam to a defined angular light distribution.

Figure 1:
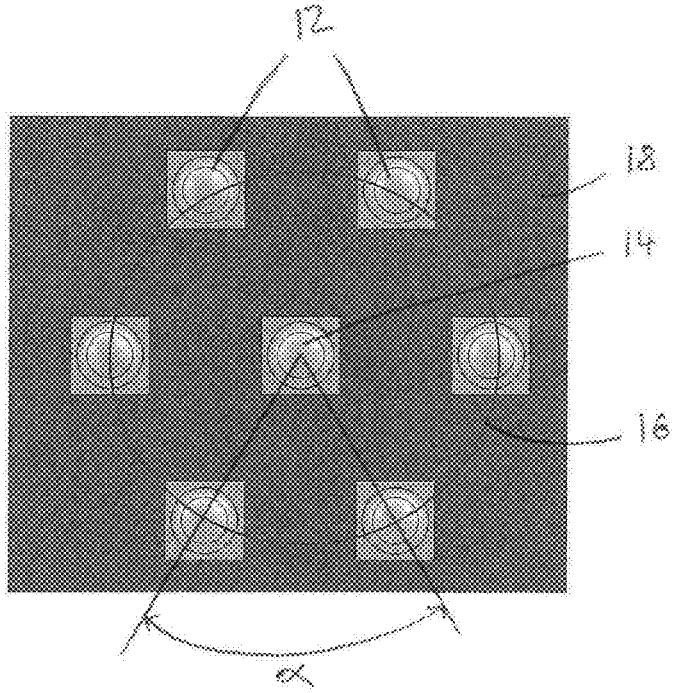
FIG. 1 illustrates a basic schematic of an arrangement of LEDs for a wayside signal in accordance with an exemplary embodiment of the present invention.

FIG. 1 illustrates a basic schematic of an arrangement 10 of LEDs 12, 14 for a wayside signal in accordance with an exemplary embodiment of the present invention. Wayside signaling is moving away from incandescent lighting to LED lighting because LED signals, herein also referred to as LED signaling devices, have improved visibility, higher reliability and lower power consumption.

According to the embodiment of FIG. 1, an arrangement 10 comprises a plurality of LEDs 12, 14, in particular one center LED 14 and multiple outer LEDs 12. The outer LEDs 12 include six LEDs 12 arranged around the center LED 14 and along circle 16 with equal distances to each other. Such a configuration may also be referred to as hexapolar configuration. Angles $\alpha$ between the circularly arranged LEDs 12 are each 60°, measured from a center of the circle 16, which coincides with the location of the center LED 14. The LEDs 12, 14 are arranged on and supported by a printed circuit board (PCB) 18. Of course, the PCB 18 can comprise many other electronic components, such as for example LED driver units, processing units, and/or optical detectors for monitoring the LEDs 12, 14. The LEDs 12, 14 can be for example LEDs with integrated lenses, but many other LED types such as pure chips or packages without lenses can be uses.

Figure 2:
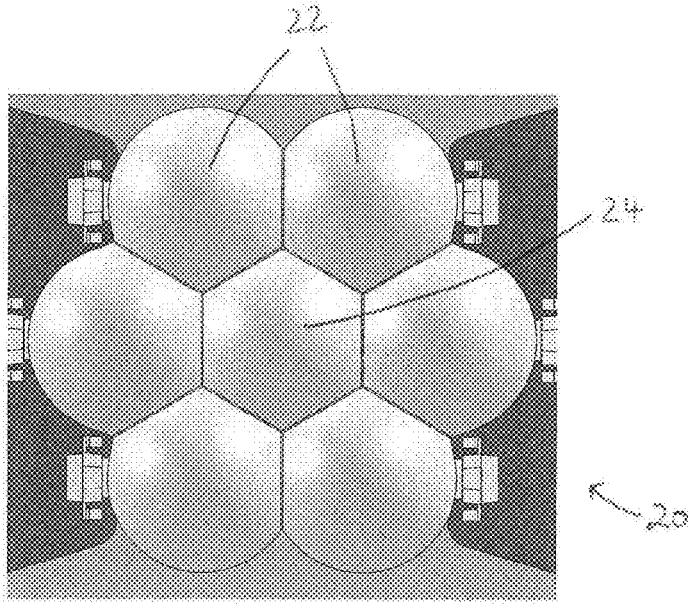
FIG. 2 illustrates a front view of a first lens of an optical system for a LED signal in accordance with an exemplary embodiment of the present invention.

FIG. 2 illustrates a front view of a first lens 20 of an optical system for a LED signal in accordance with an exemplary embodiment of the present invention.

The first lens 20 is configured as lens assembly comprising multiple individual lenses 22, 24, wherein the number of individual lenses 22, 24 corresponds to the number of LEDs used, which means that for each LED one individual lens 22, 24 is provided. In accordance with the arrangement 10 of LEDs 12, 14 of FIG. 1, the first lens 20 as illustrated in FIG. 2 comprises seven individual lenses 22, 24 as the arrangement 10 comprises seven LEDs 12, 14. The arrangement 10 as well as the first lens 20 can comprise more or less than seven LEDs 12, 14 and individual lenses 22, 24, for example four LEDs and individual lenses, but at least one LED and one individual lens 22.

The first lens 20 comprises six outer lenses 22 and one center lens 24 in accordance with the exemplary arrangement 10 of LEDs 12, 14 of FIG. 1. Each individual lens 22, 24 is designed based on a shape of a hexagon when viewed from the front as shown in FIG. 2. The center lens 24 comprises the shape of a hexagon, wherein the design of the outer lenses 22 is also based on a hexagon, but has been modified. The outer lenses 22 comprise partly the shape of a hexagon, and partly the shape of a circle. Each outer lens 22 is arranged such that the part designed as a hexagon is adjacent and connected to the center lens 24. The other parts of the outer lenses 22 designed as circles are arranged towards an outside of the first lens 20 and form an outer surface of the first lens 20.

The first lens 20 is designed to achieve maximum efficiency of coupling light out of the first lens 20 at a minimum size. Thus, the first lens 20 is designed so that an inner area of the lens 20 includes a closest, most dense, hexagonal package of individual lenses 22, 24 with mathematical continuous shape. As noted before, the outer individual lenses 22 are modified so that edges of the hexagon of each lens 22 are rounded toward an outside of the first lens 20. In an alternative embodiment, all the individual lenses 22, 24 may comprise a hexagonal shape. But designing all the individual lenses 22, 24 in circular form does not provide a mathematical continuous shape due to gaps between circles when arranging them next to each other. In another alternative, an arrangement of four LEDs in a square arrangement may be used; however, a first lens for such an arrangement may comprise a lower filling factor if individual lenses of the first lens.

In an exemplary embodiment of the present invention, the first lens 20 can be a one-piece moulded array of the multiple lenses 22, 24. Alternatively, the lens 20 can be an array of the multiple lenses 22, 24 which are assembled and then form the first lens 20.

Figure 3:
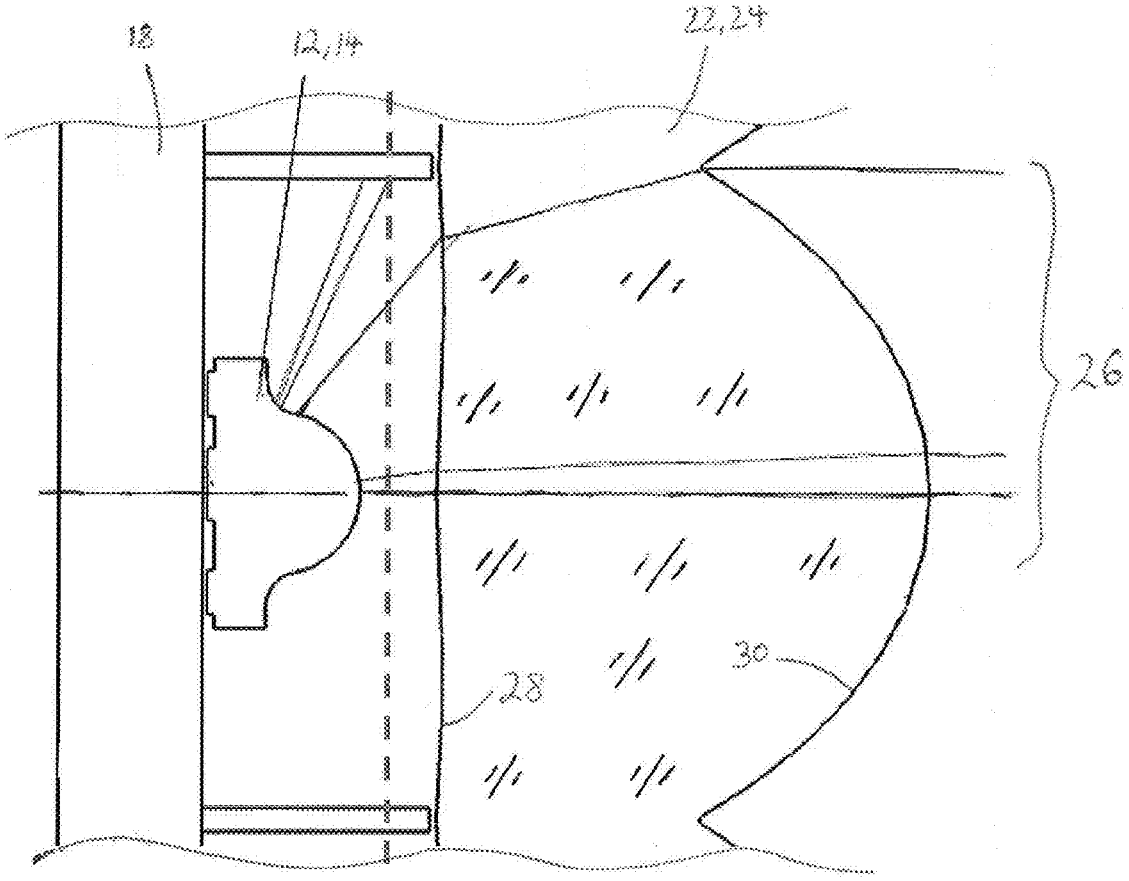
FIG. 3 illustrates a schematic cross section view of a first lens of an optical system when arranged in combination with an arrangement of LEDs including light distribution in accordance with an exemplary embodiment of the present invention.

FIG. 3 illustrates a schematic cross section view of the first lens 20 as illustrated in FIG. 2 when arranged in combination with the arrangement 10 of LEDs 12, 14 as illustrated in FIG. 1 including light distribution in accordance with an exemplary embodiment of the present invention.

Light generated by the multiple LEDs 12, 14 is collimated to a parallel beam by the first lens 20, wherein each individual lens 22, 24 is configured as a converging lens. In particular, FIG. 3 illustrates one LED 12, 14 and one individual lens 22, 24 of the first lens 20 arranged over the one LED 12, 14. As illustrated by the light distribution 26, the individual lens 22, 24 collimates the light emitted from the LED 12, 14. The individual lenses 22, 24 are each designed to that an angle of the output beam is ideally 0° (collimated, parallel beam) and that a spatial distribution of the output beams, measured as illuminance, after the first lens 20 is as homogenous as possible. In order to provide such a collimated, parallel beam with a homogenous spatial distribution of the illuminance, each individual lens 22, 24 is configured as a double sided aspheric lens, in particular a double sided convex aspheric lens. FIG. 3 shows the surface profiles 28, 30 of the individual lens 22, 24. Parameters for a double sided aspheric lens can be selected, for example depending on an angular light distribution of the light source, for example the LED 12, 14. Parameters can include but are not limited to surface radius, conic constant, aspheric coefficients r2, r4 etc. FIG. 3 further illustrates the PCB 18. As previously noted, the LEDs 12, 14 are mounted to the PCB 18.

Figure 4:
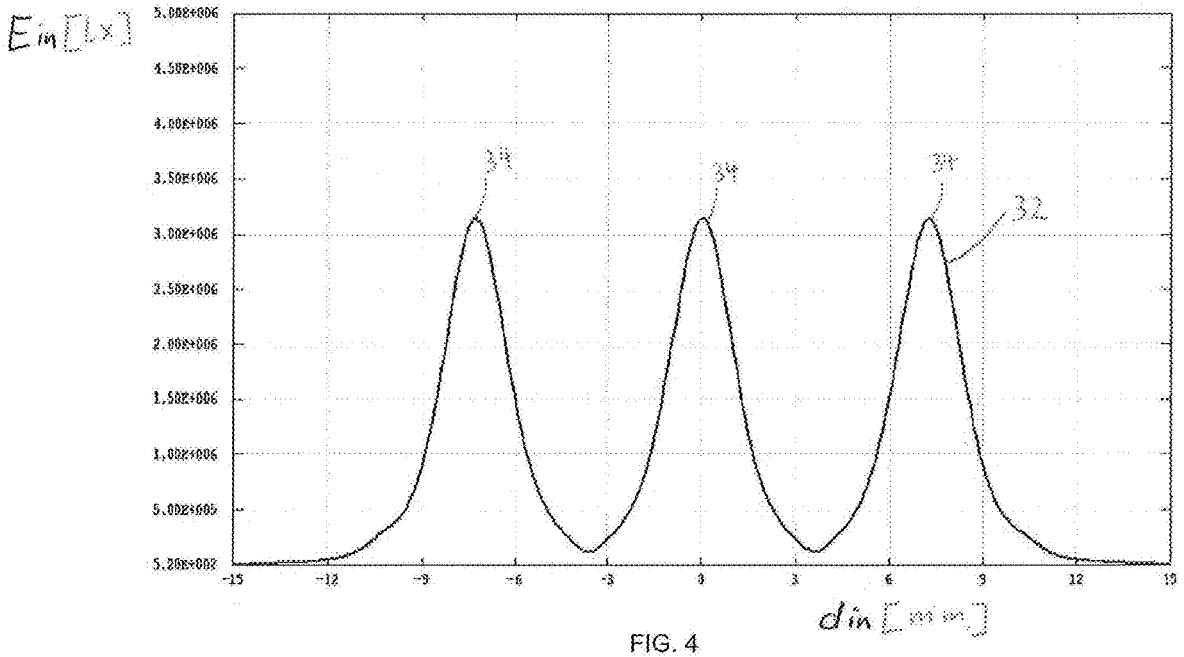
FIG. 4 and FIG. 5 illustrate diagrams including graphical representations of light distribution before and after a first lens of an optical system in accordance with exemplary embodiments of the present invention.
Figure 5:
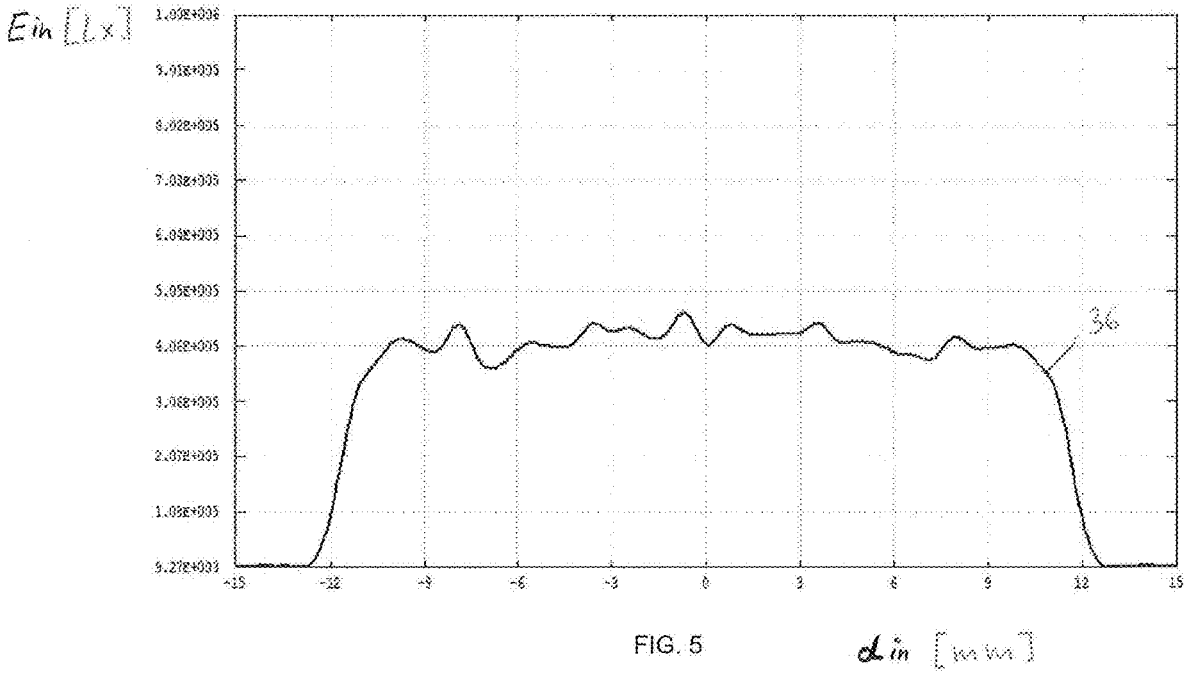

FIGS. 4 and 5 illustrate diagrams including graphical representations of light distributions before and after the first lens 20 as illustrated in FIG. 2 in accordance with exemplary embodiments of the present invention. The diagrams of FIGS. 4 and 5 comprise an X-coordinate representing a diameter of the first lens 20 in millimetre [mm], and a Y-coordinate representing illuminance in Lux [lx].

FIG. 4 illustrates a light distribution 32 generated by multiple light sources. In particular, the diagram shows the light distribution 32 generated by multiple LEDs 12, 14 as illustrated for example in FIG. 1, specifically for a cross section through multiple LEDs 12, 14 including the center LED 14. The light distribution 32 is referred to as a Lambertian distribution (I(phi)=a*cos(phi)) for pure LEDs (LED chips) or a condensed (narrowed) Lambertian distribution for lensed LEDs, wherein a maxima 34 can be identified for each light source (LED 12, 14).

In contrast, FIG. 5 illustrates a light distribution 36 generated by multiple light sources and collimated by the first lens 20. In accordance with FIG. 4, the diagram shows the light distribution 36 for the cross section through the same LEDs 12, 14. FIG. 5 shows the light distribution 36 after the first lens 20, wherein the distribution 36 is a "flat-top" distribution which means that a homogenous parallel beam over a beam cross section is achieved by the first lens 20.

It should be noted that the first lens 20 is designed so that it can be mounted to the PCB 18 (see FIG. 1), for example via bolts or screws which can be received in openings, such a threaded or tapped holes of the first lens 20. In alternative embodiments, the first lens 20 can be mounted to the PCB 18 by gluing, hot embossing, hot stamping and/or ultrasonic welding.

Figure 6:
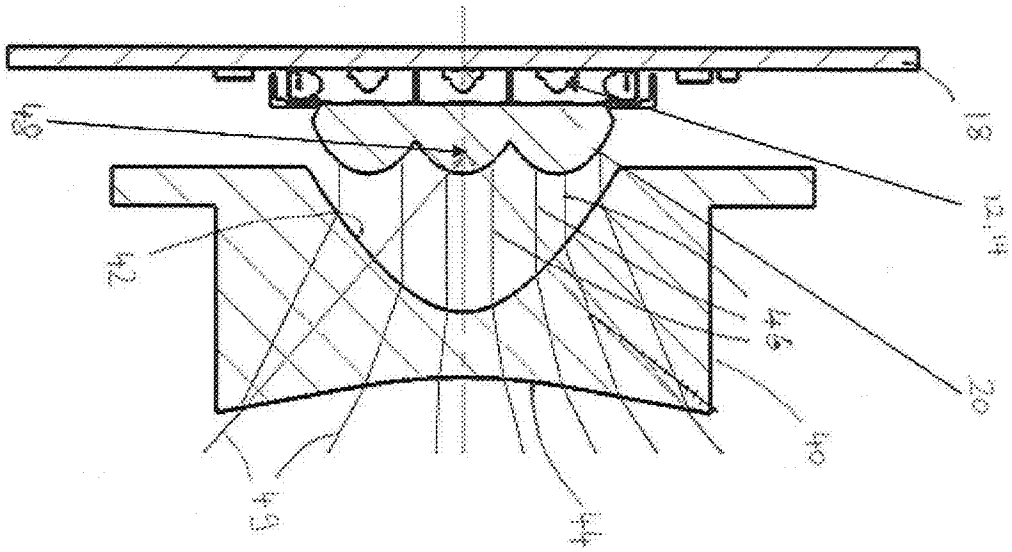
FIG. 6 illustrates a schematic cross section view of a second lens in combination with a first lens of an optical system and an arrangement of LEDs including light distribution in accordance with an exemplary embodiment of the present invention.

FIG. 6 illustrates a schematic cross section view of a second lens 40 in combination with the first lens 20 of the optical system and the arrangement 10 of LEDs 12, 14 as illustrated in FIG. 3 including light distribution in accordance with an exemplary embodiment of the present invention.

The LEDs 12, 14, the first lens 20 and the second lens 40 are arranged sequentially in an axial direction, and according to defined axial positions. First and second lenses 20, 40 are mounted to the common PCB 18.

The second lens 40 is configured as a diverging lens, in particular a doubled sided aspheric lens. FIG. 6 illustrates a surface profiles 42, 44 of the second lens 40, embodied as double sided concave aspheric lens. Parameters for a double sided aspheric lens can be selected, which can include but are not limited to surface radius, conic constant, aspheric coefficients r2, r4 etc.

Figure 9:
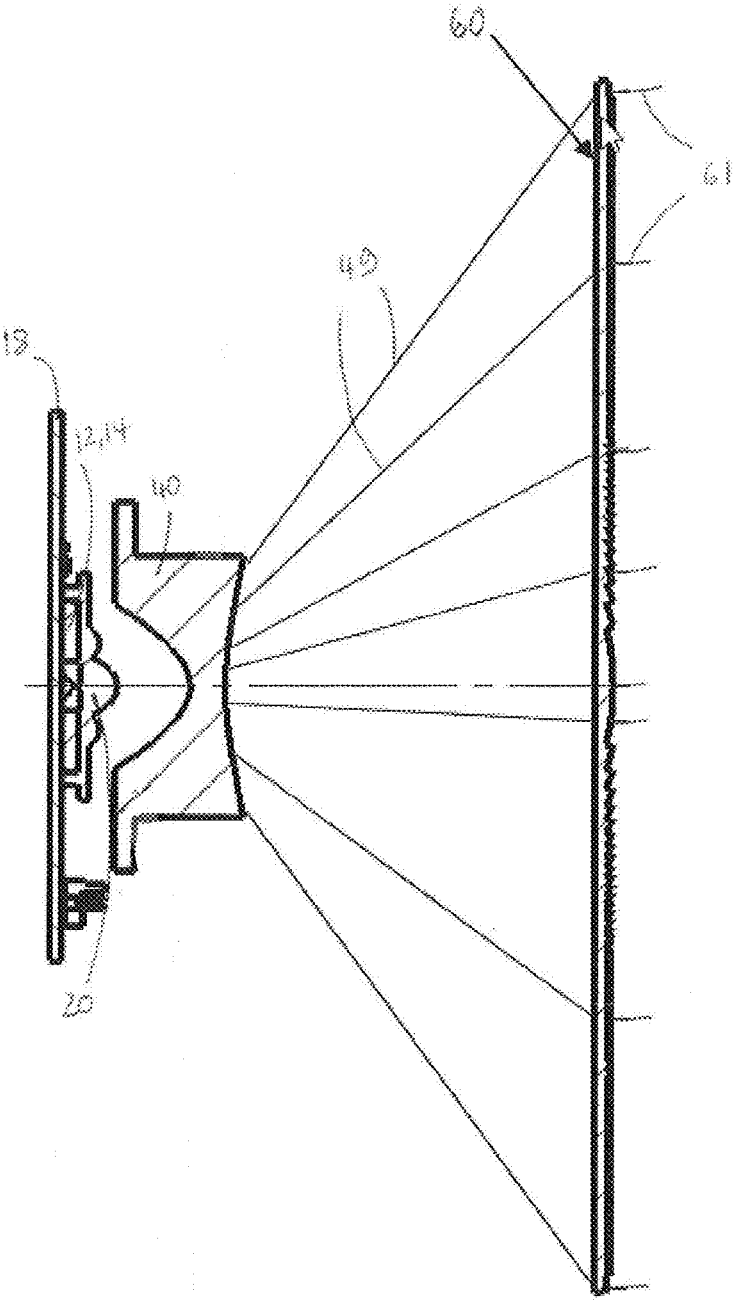
FIG. 9 illustrates a cross section of an arrangement of LEDs including a first lens, a second lens and a third lens of an optical system in accordance with an exemplary embodiment of the present invention.

Parallel output beam(s) 46 from the first lens 20 are diverged onto a third lens 60 (see FIG. 9) via the second lens 40 (see output beams 49 of the second lens 40) in such a way that a spatial light distribution, measured as illuminance, onto the third lens 60, is as homogenous as possible. In order to achieve such a homogenous spatial distribution, an angular light distribution of the output light of the second lens 40 needs to be in accordance with a configuration of the third lens 60, in particular with regard to a diameter of the third lens 60. As FIG. 9 illustrates, the diameter of the third lens 60 is significantly greater than a diameter of the second lens 40. Further, an axial length of the optical system (see FIG. 12) should be as small as possible. Thus, the second lens 40 is designed to have large-angle output rays (beams) and is designed to compensate for spherical aberration, which is typical for large-angle output rays.

Due to properties of the second lens 40 as a diverging lens, a focal point 48 of the second lens 40 is virtually on a source side, meaning that the virtual focus point 48 lies between the LEDs 12, 14 and the second lens 40, and can be within the first lens 20. Consequently, it appears that each LED 12, 14 emits light from the same point when viewing the arrangement from an image side of the third lens 60.

Figure 7:
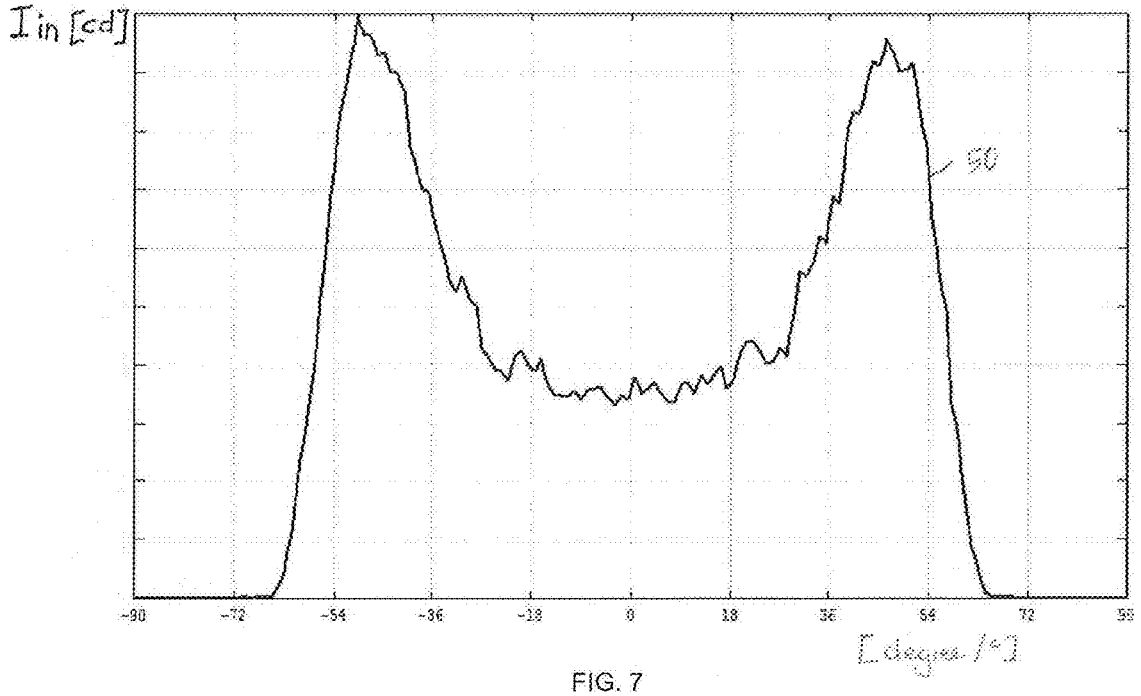
FIG. 7 illustrates a diagram including a graphical representation of a light distribution after a second lens of an optical system in accordance with an exemplary embodiment of the present invention.
Figure 8:
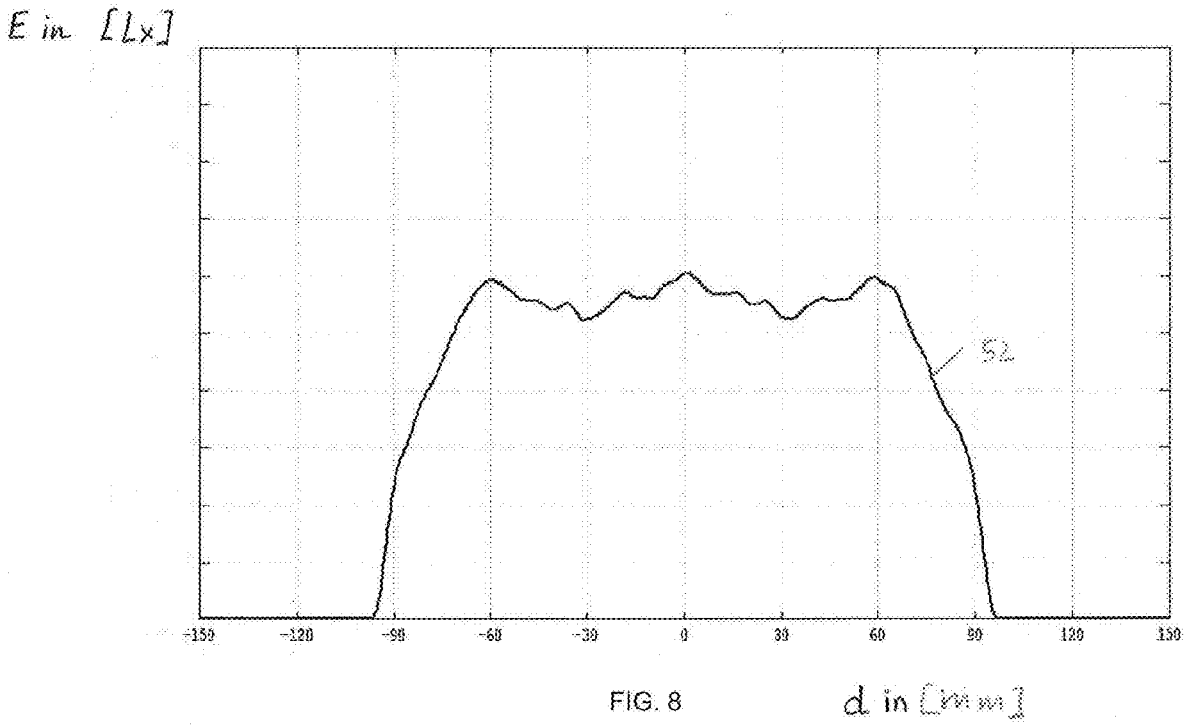
FIG. 8 illustrates a diagram including a graphical representation of a light distribution after a second lens of an optical system in accordance with an exemplary embodiment of the present invention.

FIGS. 7 and 8 illustrate diagrams including graphical representations of light distributions 50, 52 after the second lens 40 and directly before the light enters the third lens 60 in accordance with exemplary embodiments of the present invention.

The light distribution 50 of FIG. 7 represents an angular distribution, wherein the X-coordinate represents degrees [°] for the angular distribution 50, and the Y-coordinate represents luminous intensity I in Candela [cd].

FIGS. 7 and 8 refer to the same measurement location (after second lens 40 and directly before the third lens 60), but the light distributions 50, 52 are shown in different physical units. One aspect is to achieve a uniform illuminance (in Lux) over a complete area of the third lens 60, which is represented by the x-coordinate in millimetre [mm] referring to a diameter d of the third lens 60 in FIG. 8.

According to the light distribution 50, parallel light beams, i.e. light beams with no or almost no diversion (0° at the X-coordinate) comprise less luminous intensity than light beams with diversion greater than 0°. For example, light beams with a diversion around ±50° comprise the most luminous intensity.

In order to achieve the uniform illuminance over the complete area of the third lens 60, an output of the second lens 40 need to be as shown in FIG. 7.

A reason for such a desired output of the second lens 40 is for example the "Photometric Law of Distance", and an angled illumination of outer regions of the third lens 60, which can be described by the formula:

$E=I^*\cos(\text{alpha})/r^2$ ($r^2$ is $r$ square), and

Superimposed to $I$: $I=E^*r^2/\cos(\text{alpha})$, wherein E is illuminance, I is luminous intensity, alpha is an angle of incidence, and r is a distance between light source and illuminated point (area).

With further reference to FIG. 7, the light distribution 50 of FIG. 7 shows that axially, at alpha=0°, cos (0°)=1 and r=1 (relative). For another example at axially 30°, r=1.155 (triangle geometry) and cos (30°)=0.866, it is calculated, according to the formula above, $1.155^2/0.866=1.55$. This means that at 30° illumination angle of the third lens 60, the luminous intensity needs to be 1.55 times higher than at 0°.

It is important and necessary to generate the light distribution 50 after the second lens 40 as illustrated in FIG. 7 (providing more luminous intensity into larger output angles), because an area of the third lens 60 to be illuminated increases with larger radii of the third lens 60 (see FIG. 9). Furthermore, as noted before, the spatial light distribution 52 after the second lens 40, measured as illuminance as illustrated in FIG. 8, onto the third lens 60, should be as homogenous as possible.

The first lens 20 and the second lens 40 convert the light generated by the multiple LEDs 12, 14 from a Lambertian distribution into a light distribution that homogenously illuminates a plane surface (third lens 60). The configuration and arrangement of the first and second lenses 20, 40 provide the basis for a homogenous luminance of a wayside LED signal, when the optical system (see FIG. 9) is assembled within the LED signal. The second lens 40 produces one virtual focal point 48, even when multiple light sources are used within the optical system, such as for example the multiple LEDs 12, 14. Because of this one virtual focal point 48, an axial length of the optical system and the LED signal can be reduced. Further, a design of the third lens 60 does not need to be very complicated, since the design of the second lens 40 is based on point sources (due to the one virtual focal point 48) and spherical aberrations can be reduced to small values or to zero by the second lens 40.

FIG. 9 illustrates a cross section of the arrangement of LEDs 12, 14 including the first lens 20, the second lens 40 as illustrated in FIG. 6 and a third lens 60 of an optical system in accordance with an exemplary embodiment of the present invention.

According to an exemplary embodiment of the present invention, the third lens 60 is designed so that it can be used for different settings. By changing an axial position of the third lens 60 relative to a point source (for example relative to the light source), the third lens 60 can be operated in different ways.

The third lens 60 is designed as a converging lens. In order to achieve a short axial length of the optical system (see FIG. 12), the third lens 60 can be for example a Fresnel lens. A Fresnel lens is a type of a compact lens which allows a construction of lenses of large aperture and short focal length without the mass and volume of material that would be required by a lens of conventional design. One of ordinary skill in the art is familiar with the principle and construction of a Fresnel lens.

In addition to be embodied as a Fresnel lens, the third lens 60 has a focal length shorter than a lens radius, and an aspheric lens surface oriented to collimate light beams, i.e. to produce a parallel output beam. FIG. 9 further illustrates the output beams 49 of the second lens 40 and the output beams 61 of the third lens 60.

Figure 10:
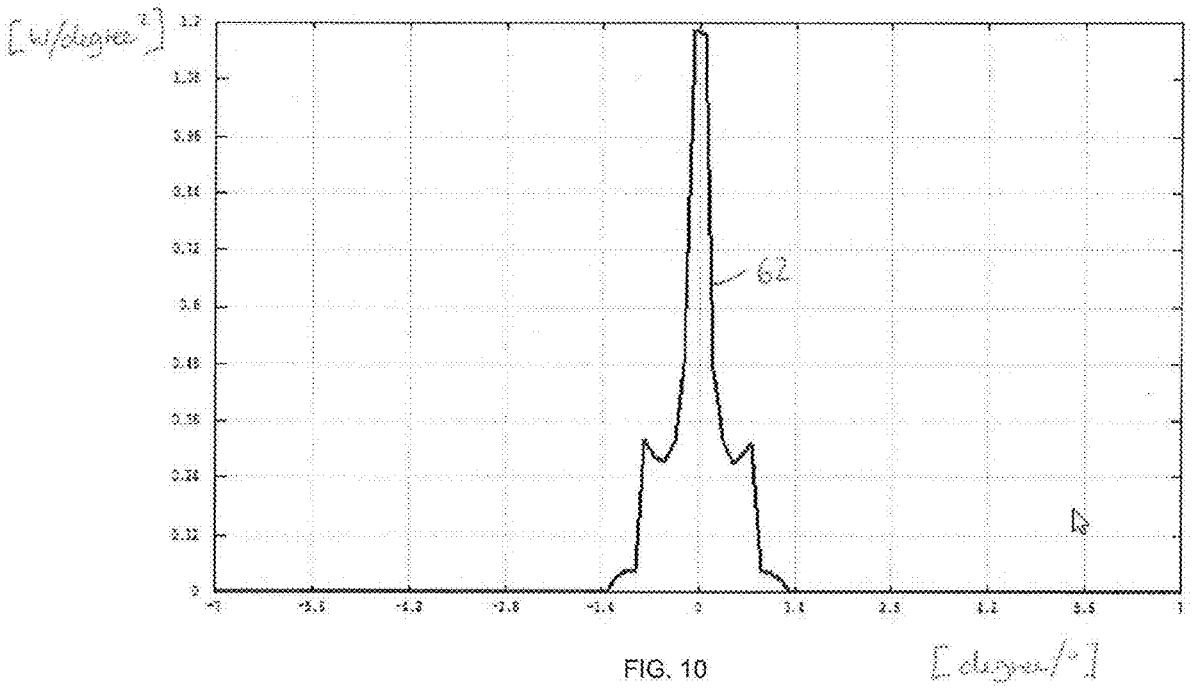
FIG. 10 illustrates a diagram including a graphical representation of a light distribution after a third lens arranged at a first axial position.
Figure 11:
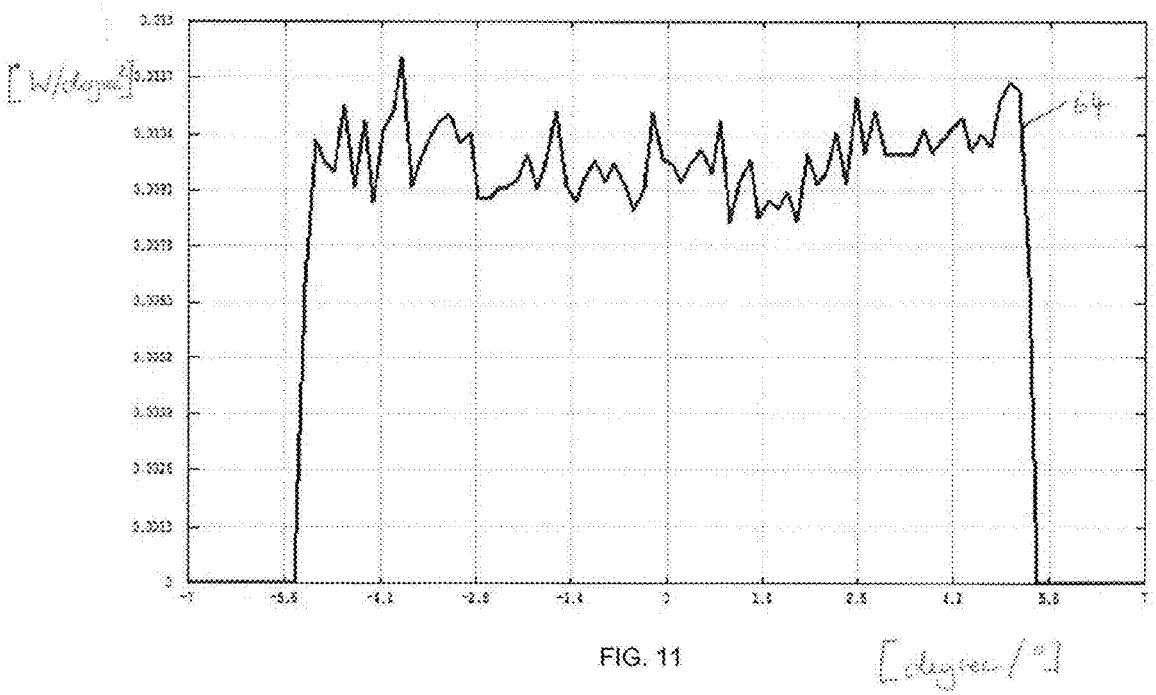
FIG. 11 illustrates a diagram including a graphical representation of a light distribution after a third lens arranged at a second axial position in accordance with exemplary embodiments of the present invention.

FIG. 10 illustrates a diagram including a graphical representation of a light distribution 62 after the third lens 60 at the first axial position, and FIG. 11 illustrates a diagram including a graphical representation of a light distribution 64 after the third lens 60 at the second axial position in accordance with exemplary embodiments of the present invention. The light distributions 62, 64 each represent an angular distribution, wherein the X-coordinate represents degrees for the angular distributions 62, 64, and the Y-coordinate represents a light intensity in watts per degree squared.

When arranging the third lens 60 at a first axial position slightly defocused from a paraxial focal point of the third lens 60, collimated output beams are parallel or essentially parallel. The first axial position corresponds to a long range (LR) application, i.e. when the LED signal is used for a LR application, the third lens 60 will be positioned at the first axial position. The LR application position corresponds to a first final angular light distribution, which is an angular light distribution with narrow angles (see also diagram of FIG. 10). A LR application for a wayside LED signal is typically an application, where the LED signal is installed in the field along straight tracks, for example train tracks, over a long distance.

When arranging the third lens 60 at a second axial position even more defocused from the paraxial focal point than the first axial position (see above), a homogenous illumination of an angular range, comprising for example +/−5 degrees, is provided (instead of essentially parallel output beams). The second axial position corresponds to a short range (SR) application, i.e. when the LED signal is used for SR applications, the third lens 60 will be positioned at the second axial position. The SR application position correspond to a second angular light distribution, which is an angular light distribution with angles wider than the (narrow) angles of the LR application (see also diagram of FIG. 11). A SR application for a wayside LED signal is typically an application, where the LED signal is installed in the field along tracks which comprise one or more curves.

A defocusing of the third lens 60 is realized by moving the third lens 60 towards a light source, for example towards the arrangement of LEDs 12, 14, to that the axial length of the optical system is reduced. In other words, the third lens 60 is moved in a direction towards the source side (paraxial) focal point of the lens 60. The third lens 60 can comprise corresponding mechanical features for arranging the third lens 60 at (at least two) different axial positions, which are not described in detail herein.

In a further exemplary embodiment, the third lens 60 is optimized for a wavelengths of red light (around 630 nm) to ensure a best possible overall system efficiency for a system that can comprise red LEDs, since red LEDs have a worst Lumen per Watt efficiency compared to other colours like green, yellow or white. Parameters such as surface data and/or material for the third lens 60 can be selected according to specific requirements.

Figure 12:
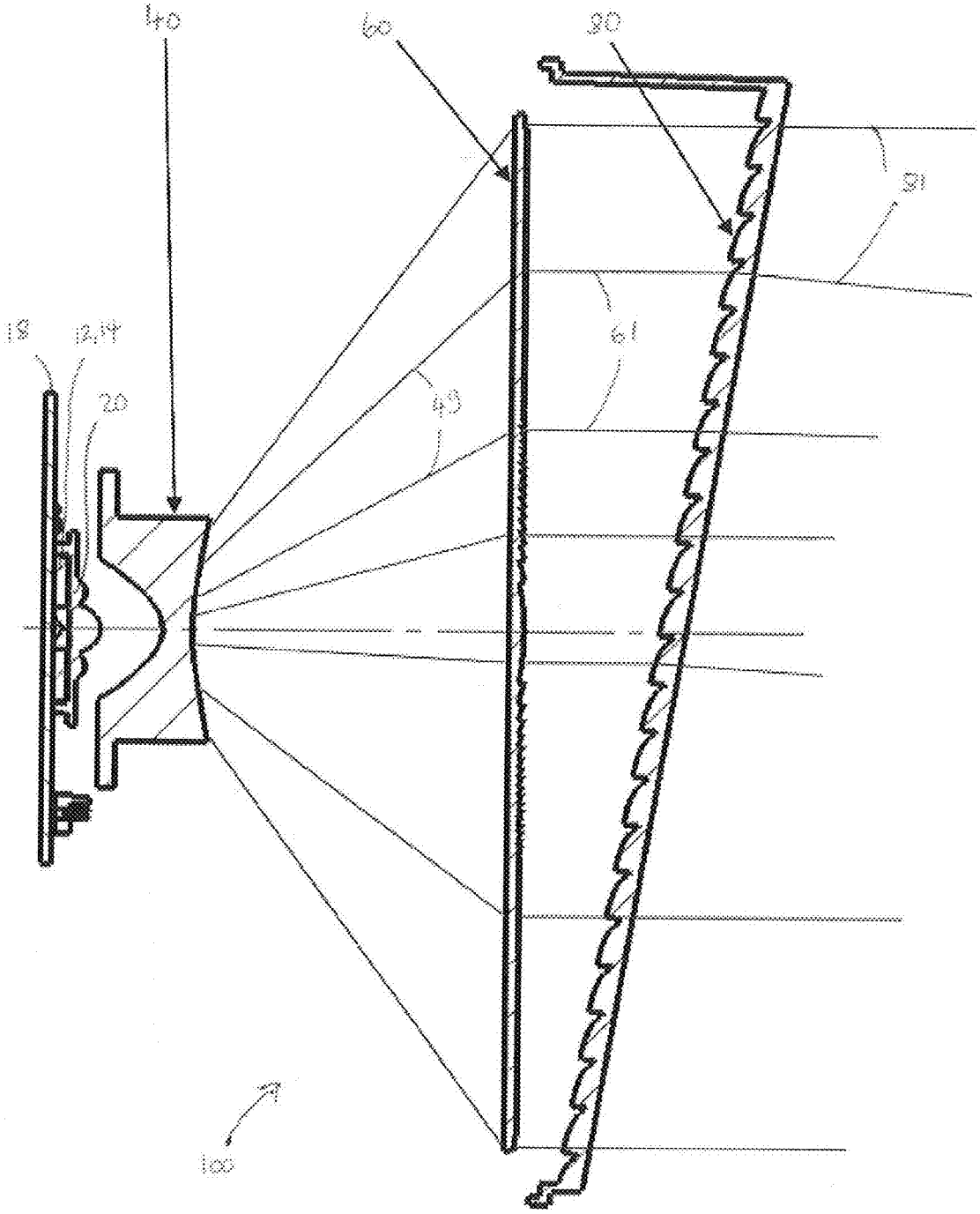
FIG. 12 illustrates a cross section of an optical system comprising an arrangement of LEDs, a first lens, a second lens, a third lens and a fourth lens in accordance with an exemplary embodiment of the present invention.

FIG. 12 illustrates a cross section of an optical system 100 comprising the arrangement of LEDs 12, 14, the first lens 20, the second lens 40, the third lens as illustrated in FIG. 9 and a fourth lens 80 in accordance with an exemplary embodiment of the present invention.

As described before, the arrangement of LEDs 12, 14, the first lens 20, the second lens 40 and the third lens 60 (see FIG. 9) of the optical system 100 are designed to provide essentially identical illuminance (lumen per square meter) of an overall area of the third lens 60, in particular of an aperture of the third lens 60, in combination with essentially identical angles of incidence onto the aperture of the third lens 60 (angles of incidence are between ±1° and ±5°, ideal angles would be 0°).

The fourth lens 80 of the optical system 100 provides desired angular output light distributions based on the illuminance and angles of incidence of the third lens 60 (see output beams 81). Additionally, the fourth lens 80 ensures a homogenous luminance of a LED signal, when the optical system 100 is installed in the LED signal, from all angular viewing positions of an observer relative to the LED signal. In other words, the fourth lens 80 ensures that when the LED signal is seen from an observer in any position, for example straight from a distant or close from an angle, the LED signal provides a signal light which is perceived by the observer as homogenous.

Figure 13:
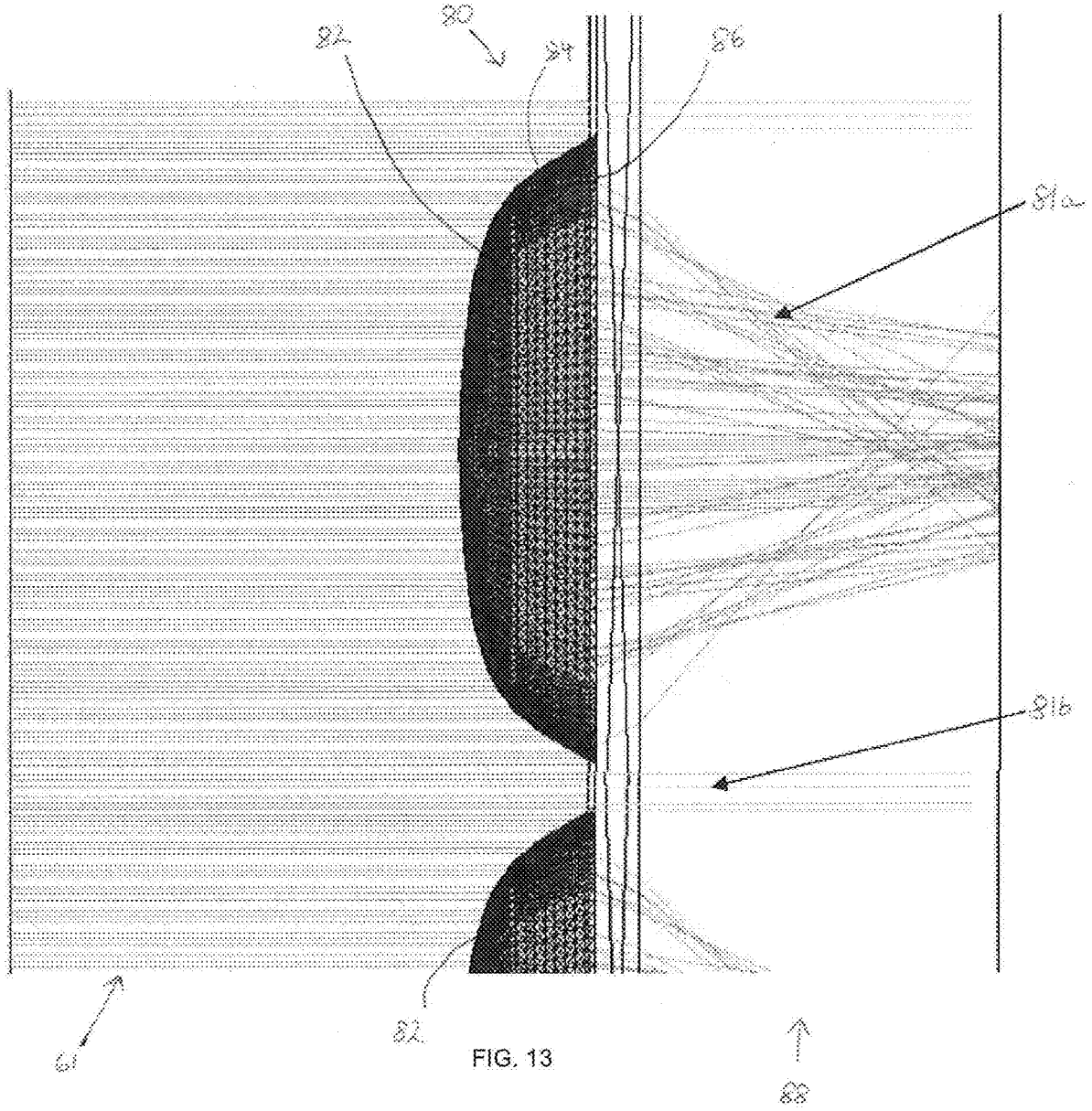
FIG. 13 illustrates an enlarged cross section view of a fourth lens in accordance with an exemplary embodiment of the present invention.

FIG. 13 illustrates an enlarged cross section view of the fourth lens 80 including light distribution in accordance with an exemplary embodiment of the present invention.

The fourth lens 80 comprises a plurality of single lenslets 82, in particular convex lenslets 82, each comprising a curved surface 84 which is oriented towards a light source of the optical system 100, which is for example the LEDs 12, 14, and a flat surface 86 oriented towards an image side 88, i.e. output of the fourth lens 80. Such a configuration and arrangement of the lenslets 82 of the fourth lens 80 allows large output angles of the lenslets 82, for example output angels up to 60°. FIG. 13 further shows a light distribution, wherein output beams 81*b* which travel through the fourth lens 80 between single lenslets 82 do not change their output angles. Output beams 81*a* which pass through the lenslets 82 will change their output angles depending on radial incident points onto the lenslet 82. FIG. 13 further shows the output beams 61 of the third lens 60.

Figure 14:
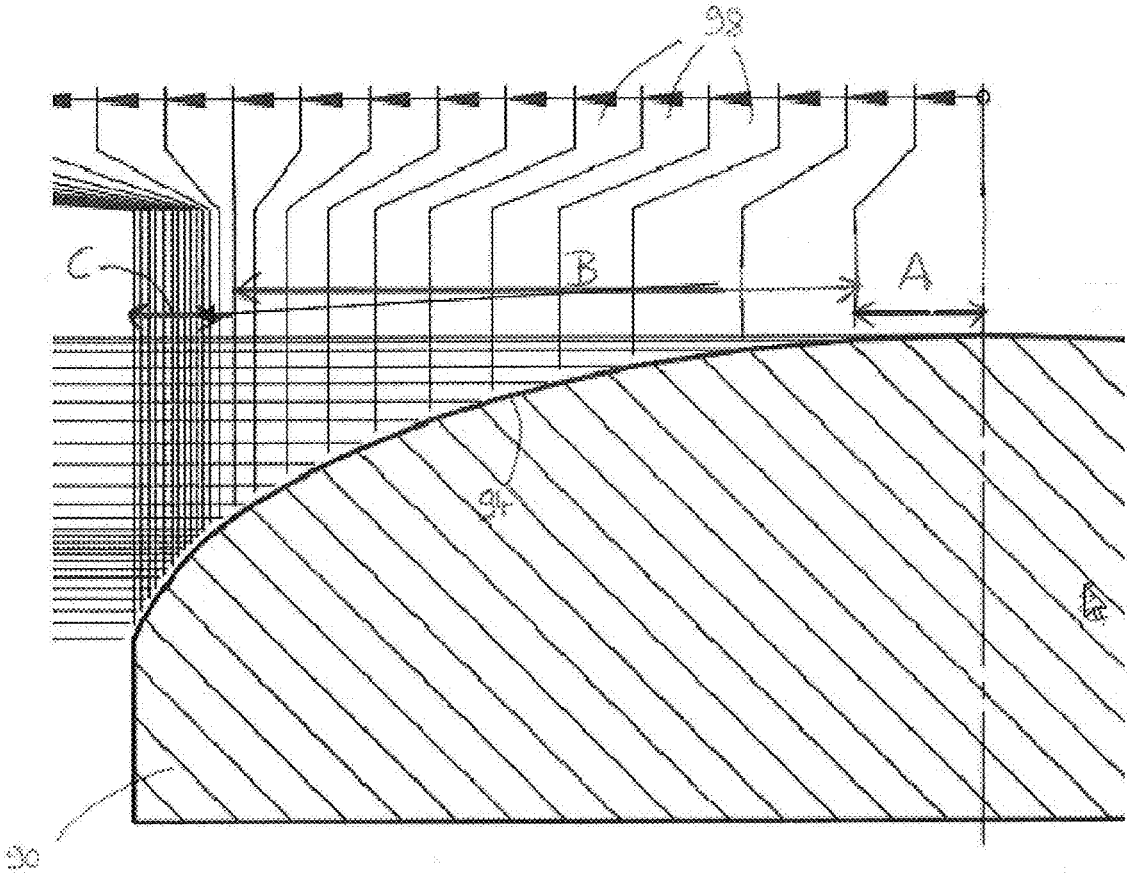
FIGS. 14 and 15 illustrate enlarged cross section views of a single lenslet of a fourth lens comprising different configurations in accordance with exemplary embodiments of the present invention.
Figure 15:
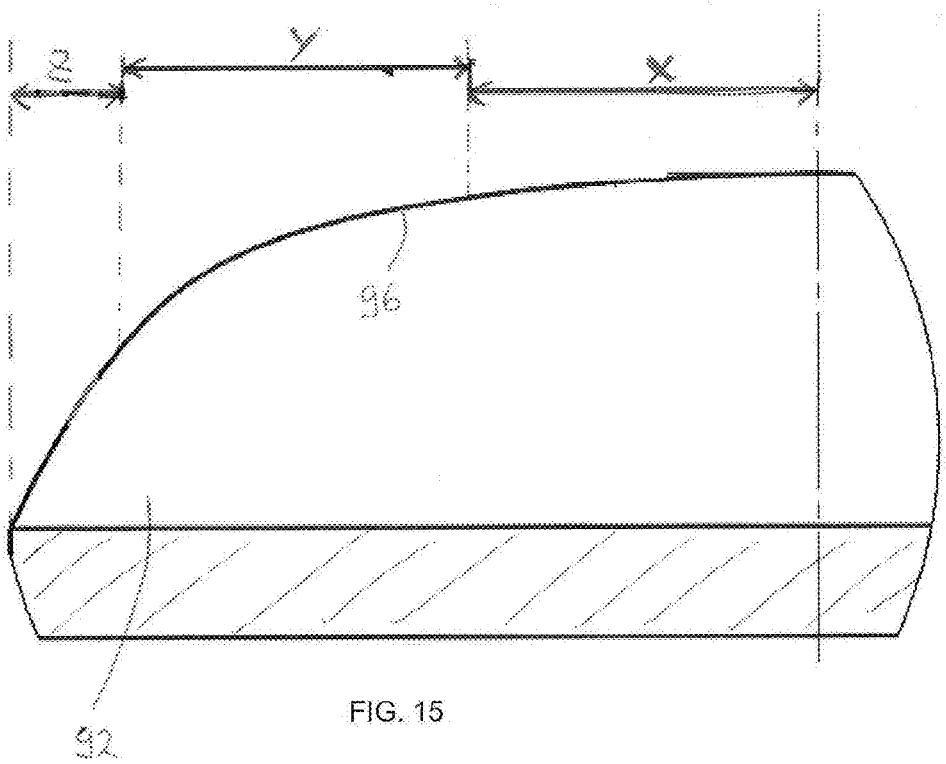

FIGS. 14 and 15 illustrate enlarged cross section views of a single lenslet 90, 92 comprising different configurations in accordance with exemplary embodiments of the present invention. Specifically, FIG. 14 illustrates an embodiment of a single lenslet 90 for short range (SR) applications, and FIG. 15 illustrates an embodiment of a single lenslet 92 for long range (LR) applications.

With reference to FIGS. 14 and 15, a shape of the convex curved surface of each lenslet 90, 92 is designed as a non-spherical surface designed to achieve a defined angular distribution at the image side 88 of the fourth lens 80 (see FIG. 13). Therefore, surfaces 94, 96 of each lenslet 90, 92 are radially subdivided in multiple sections, for example 10, 20 or 30 sections of different radial areas 98, herein also referred to as facets 98. These facets 98 can be later fitted by a spline to provide a smooth surface. Each radial area 98 corresponds to a specific surface angle. A numerical calculation of surface angles depends on a required output light distribution.

As illustrated in FIG. 14, the lenslet 90 is configured for SR applications and comprises surface 94 with a small central lenslet area A with small surface angles for low angle output (for "low" long distance visibility), a large area B with increasing surface angles (for visibility in mid-angles range) and a small area C at outer radial position with large surface angles for near-distance visibility. Area B is greater than areas A and C, and area A is greater than area C. However, it should be noted that areas A, B and C can be varied according to a required final angular light distribution of the optical system 100.

As illustrated in FIG. 15, the lenslet 92 is configured for LR applications and comprises surface 96 with a central lenslet area X with small surface angles for low angle output (for "strong" long distance visibility), a mid area Y with increasing surface angles and a small area Z at outer radial position with large surface angles for near-distance visibility. Area Z is smaller than areas X and Y, wherein areas X and Y can be similar. However, it should be noted that areas X, Y and Z can be varied according to a required final angular light distribution of the optical system 100.

An angular output of the lenslets 82, 90, 92 is independent from an absolute radial size of each lenslet 82, 90, 92. However, the more lenslets 82, 90, 92 are provided, the more evenly an aperture of the fourth lens 80 appears. Thus, the absolute radial size of the lenslets 82, 90, 92 can be selected according to visual impressions (by an observer) of a light output of the fourth lens 80 and according to feasibility of the lenslets 82, 90, 92 (less and larger lenslets, up to a certain size, are easier to manufacture).

Figure 16:
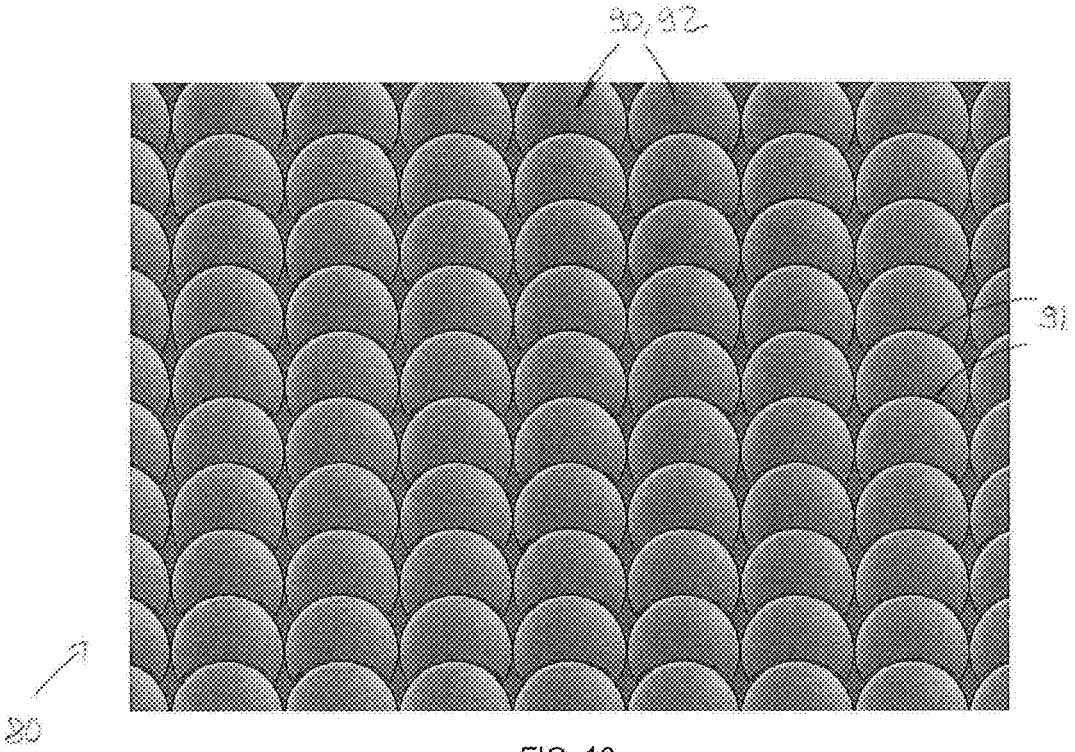
FIGS. 16 and 17 illustrate front views of a section of a fourth lens comprising multiple lenslets in accordance with exemplary embodiments of the present invention.
Figure 17:
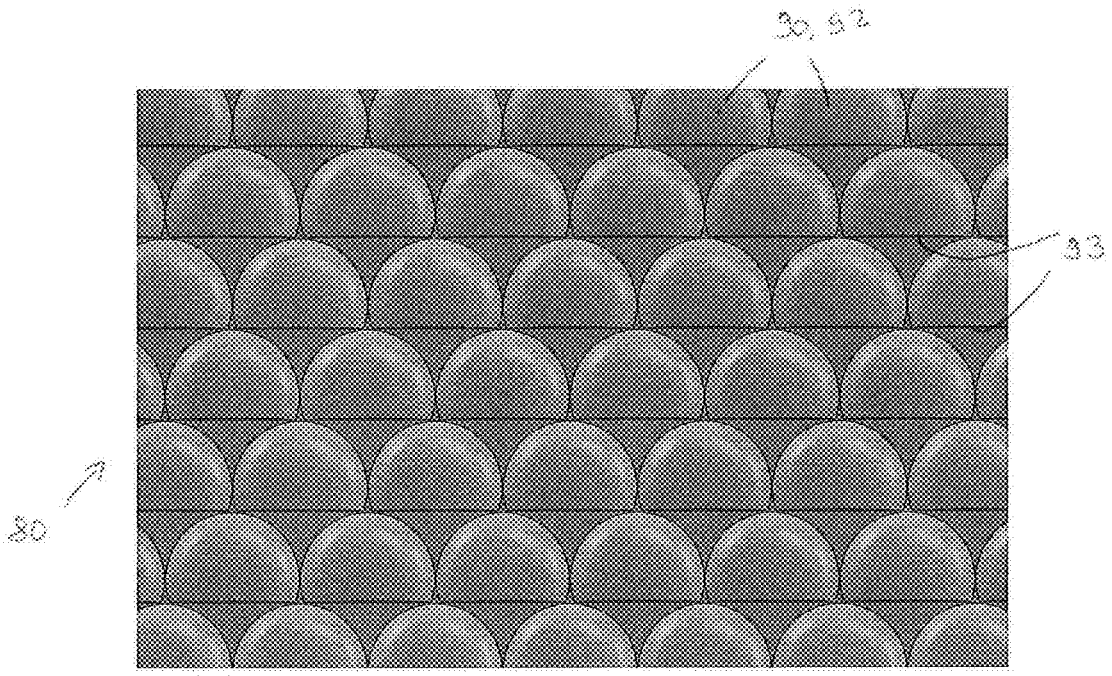

FIGS. 16 and 17 illustrate perspective front views of a section of the fourth lens 80 comprising multiple lenslets 90 or 92, respectively, as illustrated in FIGS. 14 and 15 in accordance with exemplary embodiments of the present invention.

By varying vertical and horizontal lenslet spacing, a filling factor (relation between area filled by lenslets and area not filled by lenslets) can be modified. In an exemplary embodiment of the present invention, adjacent lenslets 90 or 92 do not touch each other so that an angular light distribution of each single lenslet 90, 92 is not disturbed. Only one type of lenslets 90 or 92 are arranged within the fourth lens 80, wherein the type depends on the application of a LED signal, either SR application (lenslets 90) or LR application (lenslets 92).

FIG. 16 illustrates a design for each lenslet 90 or 92 which provides a great filling factor, i.e. largest possible filling factor relative to a total area, of the fourth lens 80. The filling factor of lenslets relative to the total area is about 82%. The lenslets 90 are cut off at one side and each comprises a "crescent cut" 91 thereby providing the great filling factor. FIG. 17 illustrates a design for each lenslet 90 or 92, wherein each lenslet 90 or 92 comprises a "straight cut" 93. The design of FIG. 17 is an alternative configuration of lenslets 90, 92, but provides a lower filling factor compared to the configuration of FIG. 16. The straight cuts 93 as well as the crescent cuts 91 are such that cut offs are less than half of each lenslet 90, 92. It is important to cut the lenslets 90, 92 below their center axes, because an upper half of each lenslets 90, 92 will refract light into lower object half-space and vice-versa. Since wayside LED signals usually are (a) mounted on a post or mast above or at least at eye height of the observer of the signal, which is usually the operator of a train, and (b) the LED signal itself is protected from sunlight with a hood mounted above the signal output, the lower part of lenslets 90, 92 is illuminating (parts of) the non-used object half-space. Thus, the lower parts of the lenslets 90, 92 can be cut off in order to provide a great filling factor and without downgrading the light output of the LED signal.

As described, in order to achieve the variations for LR and SR applications and requirements, the design of the fourth lens 80 is modified (use lenslets 90 for SR applications, and lenslets 92 for LR applications), and an axial position of the third lens 60 can be changed, wherein the arrangement of the LEDs 12, 14, the first lens 20 and the second lens 40 remains always the same. Thus, the LEDs 12, 14, the first lens 20 and the second lens 40 are mounted to the common PCB 18. The third lens 60 and fourth lens 80 comprise mechanical features to be mounted to a signal housing of a LED signal allowing a variable axial position of the third lens 60.

For an observer, for example a train operator, a visible output aperture of a wayside LED signal with the optical system 100 is the fourth lens 80. Independently from an axial and/or angular position of the observer, the observer always perceives light output from all areas of the output aperture, i.e. fourth lens 80, either from each lenslet 90, 92 or from each area in between the lenslets 90, 92, depending on a position of the observer. Thus, a homogenous appearance (luminance) of the output aperture of the LED signal is always provided.

In case of a failure of a single LED of the plurality of LEDs 12, 14, the LED signal will not be illuminated around an output aperture area of the failed LED, but the angular distribution of the signal output still remains almost the same. Therefore, there are no positions, where the signal appears completely "off" to the observer compared to a signal where all LEDs are intact. The LED signal, specifically only the related areas of the third and fourth lenses 60, 80 which are not illuminated due to failure(s) of one or more LEDs 12, 14, appear "darker" by around 1/n, wherein n is the number of total LEDs 12, 14 within the optical system 100.

Regarding a reverse illumination of the fourth lens 80, for example by incident sunlight (parallel beam) from outside (object space), total internal reflection (TIR) may happen due to the large surface angles of the lenslets 90, 92 at outer radial areas (see areas C and Z in FIGS. 14 and 15). Depending on the design of the lenslets 90, 92 for LR- or SR-applications, 30% to 40% of incident light will be backscattered by TIR and Fresnel reflections. Due to a non-spherical design, the lenslets 90, 92 do not have a small focus diameter but a relatively large focus area. Such a configuration prevents focusing incident parallel beam to a small high energy spot onto the following third lens 60. Sunlight which does not touch lenslets 90, 92 of the fourth lens 80, i.e. passes between lenslets 90, 92 (see 81*b* in FIG. 13), will pass through the fourth lens 80 without changing incident angles. A percentage of sunlight passing between lenslets 82, 90, 92 is about 18%, depending on the filling factor of the fourth lens 80. The sunlight passing between lenslets 90, 92 travels to and is focused by the third lens 60. But the third lens 60 is not positioned at an ideal focal position, which means that an input beam of the sunlight will not be focused to any small point within the optical system 100 and will therefore not destroy any components within the optical system 100.

The described configuration of the optical system 100 comprising multiple LEDs 12, 14, and the first, second, third and fourth lenses 20, 40, 60 and 80 provides a compact arrangement. Compactness is achieved by mounting the components sequentially in an axial direction with low tolerances and by configuring the lenses 20, 40, 60, 80 according (for example using a Fresnel lens for the third lens 60).

According to exemplary embodiments of the present invention, the multiple lenses 20, 40, 60, 80 comprise plastic material, such as for example polycarbonates and/or polymethyl methacrylate (PMMA). Specifically, the third lens 60 can comprise for example ZEONEX®, manufactured for example by Zeon, which comprises cyclo olefin polymers.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

The invention claimed is:

1. An optical system for a light emitting diode (LED) signal comprising:

a plurality of light emitting diodes (LEDs), a plurality of optical lenses for diverging and collimating light generated by the plurality of LEDs, wherein the plurality of optical lenses comprises a first lens, a second lens, a third lens and a fourth lens, wherein the plurality of LEDs and the plurality of optical lenses are sequentially arranged in an axial direction, and wherein the plurality of optical lenses are configured such that by altering an axial position of one of the optical lenses from a first defined axial position to a second defined axial position, a final angular light distribution of the optical system is variable, wherein the fourth lens collimates the light and provides the final angular light distribution, wherein the fourth lens comprises an array of multiple identical convex lenslets, each lenslet comprising a curved surface oriented towards the plurality of LEDs and a flat surface oriented towards an output of the fourth lens.

2. The optical system as claimed in claim 1, wherein the first defined axial position corresponds to a first final angular light distribution of the optical system, the first final angular light distribution corresponding to a short range (SR) application of a LED signal.

3. The optical system as claimed in claim 1, wherein the second defined axial position corresponds to a second final angular light distribution which is different from the first final angular light distribution, the second final angular light distribution corresponding to a long range (LR) application of a LED signal.

4. The optical system as claimed in claim 1, wherein the first lens is positioned after the plurality of LEDs in an axial direction, the first lens collimating light generated by the plurality of LEDs.

5. The optical system as claimed in claim 4, wherein the first lens comprises an assembly of individual lenses, a number of the individual lenses corresponding to a number of the plurality of LEDs.

6. The optical system as claimed in claim 1, wherein the second lens is positioned after the first lens in the axial direction, the second lens diverging the light with an essential homogenous illuminance.

7. The optical system as claimed in claim 6, wherein the second lens is configured as a doubled sided aspheric lens.

8. The optical system as claimed in claim 1, wherein the third lens is positioned after the second lens in the axial direction, the third lens collimating the light.

9. The optical system as claimed in claim 8, wherein an axial position of the third lens is alterable from a first defined axial position to a second defined axial position, thereby varying the final angular light distribution of the optical system.

10. The optical system as claimed in claim 8, wherein the third lens is configured as Fresnel lens.

11. The optical system as claimed in claim 1, wherein the multiple identical lenslets each comprise a cutout.

12. The optical system as claimed in claim 1, wherein the fourth lens comprises an array of identical first lenslets or second lenslets for providing the first or second final angular light distributions of the optical system.

13. The optical system as claimed in claim 12, wherein the first lenslets or the second lenslets are arranged on a plate such that interspaces are provided between the individual first lenslets or second lenslets.

14. The optical system as claimed in claim 1, wherein the plurality of LEDs, the first lens and the second lens are mounted to a common printed circuit board.

15. A wayside LED signal comprising:

a plurality of light emitting diodes (LEDs);

a plurality of optical lenses for diverging and collimating light generated by the plurality of LEDs, wherein the plurality of optical lenses comprises a first lens, a second lens, a third lens and a fourth lens, wherein the plurality of LEDs and the plurality of optical lenses are sequentially arranged in an axial direction, and wherein the plurality of optical lenses are configured such that by altering an axial position of one of the optical lenses from a first defined axial position to a second defined axial position, a final angular light distribution of the optical system is variable, wherein the fourth lens collimates the light and provides the final angular light distribution, wherein the fourth lens comprises an array of multiple identical convex lenslets, each lenslet comprising a curved surface oriented towards the plurality of LEDs and a flat surface oriented towards an output of the fourth lens.

16. The wayside LED signal as claimed in claim 15, wherein the plurality of LEDs and at least one of the plurality of optical lenses are mounted to a common printed circuit board.

17. The wayside LED signal as claimed in claim 15, wherein at least one of the plurality of optical lenses is interchangeably mounted to the LED signal.

18. The wayside LED signal as claimed in claim 15, wherein at least one of the plurality of optical lenses comprises an array of identical first lenslets or second lenslets for providing the final angular light distributions of the optical system.

* * * * *